US005605192A

United States Patent [19]

Bjørnstad

[11] Patent Number: 5,605,192

[45] Date of Patent: Feb. 25, 1997

[54] MEANS AND METHOD TO DISPLACE A LOGGING TOOL TO THE BOTTOM OF A WELL FOR WITHDRAWAL THROUGH THE WELL

[75] Inventor: Thor Bjørnstad, Sør Audnedal, Norway

[73] Assignee: Den Norske Stats Oljeselskap A.S., Stavanger, Norway

[21] Appl. No.: 495,524

[22] PCT Filed: Jan. 31, 1994

[86] PCT No.: PCT/NO94/00026

§ 371 Date: Sep. 5, 1995

§ 102(e) Date: Sep. 5, 1995

[87] PCT Pub. No.: WO94/17278

PCT Pub. Date: Aug. 4, 1994

[30] Foreign Application Priority Data

Jan. 29, 1993 [NO] Norway ..... 930304

[51] Int. Cl.[6] ..... E21B 23/08

[52] U.S. Cl. ..... 166/254.2; 166/153; 166/383

[58] Field of Search ..... 166/254.2, 383, 166/153, 156

[56] References Cited

U.S. PATENT DOCUMENTS

| | | | |
|---|---|---|---|
| 4,349,072 | 9/1982 | Escaron et al. | 166/254.2 |
| 4,488,597 | 12/1984 | Hoppe et al. | 166/254.2 |
| 4,570,709 | 2/1986 | Wittrisch | 166/254.2 |
| 5,209,304 | 5/1993 | Nice | 166/383 |

FOREIGN PATENT DOCUMENTS

| | | |
|---|---|---|
| 0511735 | 11/1992 | European Pat. Off. . |
| 2232177 | 12/1990 | United Kingdom . |

*Primary Examiner*—William P. Neuder
*Attorney, Agent, or Firm*—Scully, Scott, Murphy & Presser

[57] ABSTRACT

A device and method for displacing a logging tool to the bottom of a well. The lower end of the logging g tool is connected with an upper member which is releasably connected with a plug being displaced along the well. A lower member is releasably connected with the plug, protruding downwardly from the plug and being adapted to abut the bottom end of the well, thereby rupturing the connection thereof with the plug. Thereafter the lower member strikes the upper member such that the upper member is released from the plug, enabling the upper member together with the logging tool to be hauled back thereby registering required well parameters.

8 Claims, 1 Drawing Sheet

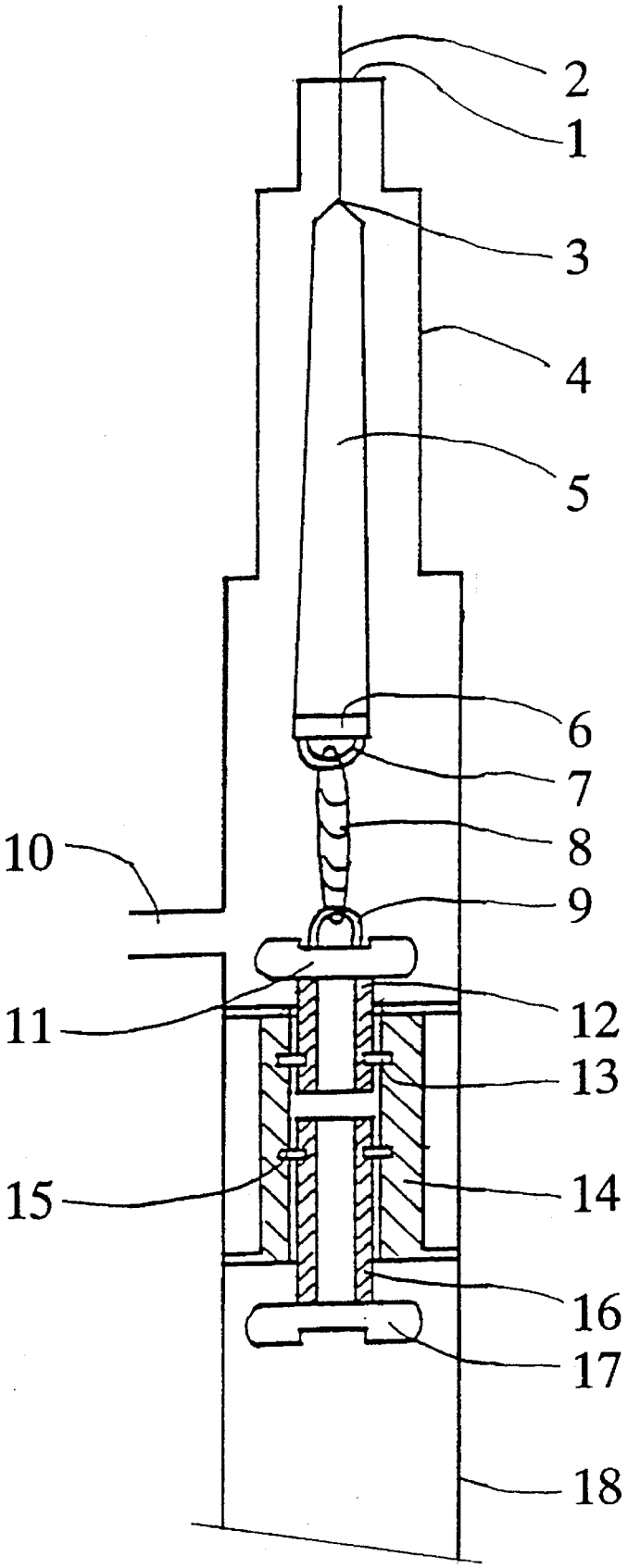
2
1
3
4
5
6
7
8
9
10
11
12
13
14
15
16
17
18

MEANS AND METHOD TO DISPLACE A LOGGING TOOL TO THE BOTTOM OF A WELL FOR WITHDRAWAL THROUGH THE WELL

BACKGROUND OF THE INVENTION

1. Field of the Invention

The present invention is related to a means and a method to displace a logging tool to the bottom of a well for withdrawal through the well.

2. Discussion of the Prior Art

Well known is to lower logging tools into the casings of wells to register parameters of different kinds along the depth of the well. In substantially vertically directed wells, the gravity forces aims lowering the tool to the desired position such as the bottom of the well. The increased use of deviation drilling, creates wells having their main axis direction extending in angles to the vertical plane, which obviously are increasing and already may extend approximately in the horizontal direction. In such a well, the axis of which is deviating strongly from the vertical direction, difficulties arise in positioning logging tools at the bottom or the end of the well, due to the decreasing effect available from the gravity forces.

In fact, such a tool may be brought to the end of the well by assembling drill pipes, which, however, is a rather expensive and time consuming operation.

SUMMARY OF THE INVENTION

The method and means according to the present invention provide a secure and efficient way to transport a logging tool down through a well, in fact even enabling measurement of parameters during the descending operation as well as the following ascending operation. Necessary equipment is easily installed on the drilling deck of a platform offshore or in other suitable structure on shore. The invention is applicable for utilization in wells independently of the angle the axis is deviating from the vertical plane.

The above mentioned advantages are achieved with the method and means according to the present invention as defined by the features stated set forth in more specific detail hereinbelow.

BRIEF DESCRIPTION OF THE DRAWING

The only FIGURE discloses an axial section through the means according to the invention, in a position ready for descending into the well.

DETAILED DESCRIPTION OF A PREFERRED EMBODIMENT

The means according to the present invention, comprises a plug 14 having a through-going hole in which two sleeves 12 and 16 are inserted, one from each end. To the lower end of the lower sleeve 16 is secured an abutment plate 17. The sleeve 16 is secured to the plug 16 such that the plate 17 is arranged at a distance from the lower end of the plug 14, said distance being larger than the distance between the two sleeves 16 and 12 in the through-going hole of the plug 14. Correspondingly a plate 11 is secured to the upper end of the upper sleeve 12 which protrudes a certain distance above the upper surface of the plug 14.

Sleeves 12 and 16 both are secured to the plug 14 by rupture pins 13 and 15 respectively. Rupture pins 15 in the lower sleeve 16 are made weaker than rupture pins 13 in the upper sleeve 12. Securement of the sleeves may be achieved also by electric or hydraulic means, enabling a locking function to be remote released when reaching desired position or the bottom or end of the casing or well.

A securement clevis 9 is connected with the upper plate 11. A shock absorber 8 furthermore connects the clevis 9, which preferably is made of a light metal type material, with a securement clevis 7 made of metal and being connected with a swivel 6 to which a logging tool 5 is connected. By means of a weak point connection 3, the logging tool 5 is connected with a wire 2 for lowering and lifting the equipment. The weak point connection 3 may be helpful in cases where the logging tool 5 is jammed in the casing, thereby making it possible to haul up the wire alone.

Shock absorber 8 hamper external effects on the logging tool while ascending and descending, thereby to ensure measurement results of good quality, e.g. to avoid influence from the lower sleeve 12 or its upper plate 11 on the path and velocity of the logging tool 5.

Preparing the equipment for use comprises a cover 4 through the upper end of which an aperture with a mud seal 1 is arranged, thereby allowing the wire 2 to pass through the cover. The cover 4 is secured to the upper end of a casing 18 and further comprises an inlet 10 for mud, arranged above the plug 14.

By forcing mud through the inlet 10, plug 14 will be pressed downwardly into the well, independently in which deviation angle of the well may be directing.

Principally it is possible to utilize the downwardly directed movement of the logging tool 5 to register parameters, as will be the case when hauling up the logging tool 5.

In case the plug should jam, the clevis 9 may be ruptured by pulling wire 2, thereby enabling rescue of the logging tool 5.

When the plug is approaching the bottom shoe of the casing, cushion plate 17 will abut the bottom shoe. By increasing the mud pressure and/or sending pressure shocks down through the casing, plug 14 will be pressed towards the plate 17, pins 15 will rupture, the upper surface of the sleeve 16 will abut against the lower surface of the sleeve 12. By increased pressure shocks, pins 13 will rupture and the sleeve 12 with the plate 11 will be released from the plug, thereby enabling the logging tool 5 to be hauled up, thereby registering the parameters in question.

I claim:

1. A device for displacing a logging tool to the bottom of a well; a plug having a central bore being located in said well in spaced relationship below a lower end of said logging tool; a first member being located in an upper portion of said plug bore and protruding upwardly from said plug, said first member being connected to the lower end of said logging tool; means for releasably connecting said first member to said plug; a second member being located in a lower portion of said plug bore and protruding downwardly from said plug into said well; and means releasably connecting said second member with said plug, whereby upon said second member abutting the bottom of the well, the means for releasably connecting said second member to said plug are ruptured to facilitate said released second member to impact said first member and cause said means releasably connecting said first member to said plug to rupture thereby enabling said first member in connection with said logging tool to be hauled upwardly from said well to enable the registering of well parameters.

2. A device as claimed in claim 1, wherein a shock absorber is connected between said first member and said logging tool so as to reduce impact shocks being transmitted to said logging tool during registering of said well parameters.

3. A device as claimed in claim 1 or 2, wherein each of said first and second members comprises, respectively, an upper and lower sleeve located in said plug bore, the lower end of said upper sleeve being spaced from the upper end of said lower sleeve, said releasable connecting means for the upper sleeve comprising a plurality of rupture pins, said releasable connecting means for the lower sleeve comprising a plurality of rupture pins which are weaker than the rupture pins for said upper sleeve whereby upon said second member abutting the bottom of the well there are initially sheared the rupture pins for the lower sleeve causing the lower sleeve to be displaced upwardly into contact with the upper sleeve to thereby shear the rupture pins thereof and release the first member and logging tool from said plug.

4. A device as claimed in claim 1, including means which forces mud into said well above said plug so as to move said second member downwardly into abutting contact with the bottom of the well with a force sufficient to cause the release of said first member and logging tool from said plug.

5. A method for positioning a logging tool at the bottom of a well wherein a lower end of said tool is connected to a plug, said plug having a central bore being located in said well in spaced relationship below a lower end of said logging tool; a first member being located in an upper portion of said plug bore and protruding upwardly from said plug, said first member being connected to the lower end of said logging tool; means for releasably connecting said first member to said plug; a second member being located in a lower portion of said plug bore and protruding downwardly from said plug into said well; and means releasably connecting said second member with said plug; comprising lowering said logging tool to cause said second member to abut the bottom of the well and rupturing the means for releasably connecting said second member to said plug; causing said released second member to impact said first member and rupturing said means releasably connecting said first member to said plug thereby enabling said first member in connection with said logging tool to be hauled upwardly from said well to enable the registering of parameters of said well.

6. A method as claimed in claim 5; comprising connecting a shock absorber between said first member and said logging tool so as to reduce impact shocks being transmitted to said logging tool during registering of said well parameters.

7. A method as claimed in claim 5, wherein each of said first and second members comprises, respectively, an upper and lower sleeve located in said plug bore, the lower end of said upper sleeve being spaced from the upper end of said lower sleeve, said releasable connecting means for the upper sleeve comprising a plurality of rupture pins, said releasable connecting means for the lower sleeve comprising a plurality of rupture pins which are weaker than the rupture pins for said upper sleeve whereby upon said second member abutting the bottom of the well there are initially sheared the rupture pins for the lower sleeve causing the lower sleeve to be displaced upwardly into contact with the upper sleeve so as to shear the rupture pins for the upper sleeve to thereby release the first member and logging tool from said plug.

8. A method as claimed in claim 5, wherein mud is forced into said well above said plug so as to move said second member downwardly into abutting contact with the bottom of the wells with a force sufficient to release said first member and logging tool from said plug.

* * * * *